US011680370B2

(12) United States Patent
Soidinsalo

(10) Patent No.: US 11,680,370 B2
(45) Date of Patent: Jun. 20, 2023

(54) MICROFIBRILLATED CELLULOSE FOAMS

(71) Applicant: Borregaard AS, Sarpsborg (NO)

(72) Inventor: Otto Soidinsalo, Sarpsborg (NO)

(73) Assignee: Borregaard AS, Sarpsborg (NO)

( * ) Notice: Subject to any disclaimer, the term of this patent is extended or adjusted under 35 U.S.C. 154(b) by 806 days.

(21) Appl. No.: 16/494,756

(22) PCT Filed: Mar. 22, 2018

(86) PCT No.: PCT/EP2018/057289

§ 371 (c)(1),
(2) Date: Sep. 16, 2019

(87) PCT Pub. No.: WO2018/177878

PCT Pub. Date: Oct. 4, 2018

(65) Prior Publication Data

US 2020/0032454 A1 Jan. 30, 2020

(30) Foreign Application Priority Data

Mar. 30, 2017 (EP) ..... 17163804

(51) Int. Cl.

| | |
|---|---|
| ***D21H 11/18*** | (2006.01) |
| ***D21H 17/25*** | (2006.01) |
| ***D21H 21/56*** | (2006.01) |
| ***D21H 27/08*** | (2006.01) |

(52) U.S. Cl.

CPC ..... *D21H 11/18* (2013.01); *D21H 17/25* (2013.01); *D21H 21/56* (2013.01); *D21H 27/08* (2013.01)

(58) Field of Classification Search

CPC ..... D21H 11/18; D21H 17/25; D21H 21/56; D21H 27/08

See application file for complete search history.

(56) References Cited

U.S. PATENT DOCUMENTS

| | | | | |
|---|---|---|---|---|
| 4,341,807 | A | 7/1982 | Turbak et al. | |
| 4,374,702 | A | 2/1983 | Turbak et al. | |
| 4,481,077 | A | 11/1984 | Herrick | |
| 9,643,147 | B2 * | 5/2017 | van Engelen | C11D 17/0013 |
| 11,375,929 | B2 * | 7/2022 | Chaum | A61M 5/14216 |
| 2012/0302440 | A1 * | 11/2012 | Theliander | A61L 15/28 604/376 |

(Continued)

FOREIGN PATENT DOCUMENTS

| | | | | |
|---|---|---|---|---|
| AU | 2021201286 | B2 * | 7/2022 | B32B 29/06 |
| CN | 101288778 | A * | 10/2008 | |

(Continued)

OTHER PUBLICATIONS

Machine Translation of CN-102274549-A (Description and Claims only) (Year: 2011).*

(Continued)

*Primary Examiner* — Jose A Fortuna

(74) *Attorney, Agent, or Firm* — Choate, Hall & Stewart LLP; Michael D. Schmitt

(57) ABSTRACT

The present invention relates to porous foam materials comprising or essentially consisting of microfibrillated cellulose ("MFC"). These porous foam materials are light weight and can be tailored to specific uses. The present invention also relates to a process for making porous foam materials according to the present invention.

10 Claims, 4 Drawing Sheets

(56) References Cited

U.S. PATENT DOCUMENTS

| | | | | |
|---|---|---|---|---|
| 2020/0032454 | A1* | 1/2020 | Soidinsalo | D21H 11/18 |
| 2021/0130500 | A1* | 5/2021 | Vuorinen | C12N 1/22 |

FOREIGN PATENT DOCUMENTS

| | | | | | |
|---|---|---|---|---|---|
| CN | 102274549 | A | * | 12/2011 | |
| CN | 110475929 | A | * | 11/2019 | D21H 11/18 |
| CN | 109071346 | B | * | 6/2022 | C04B 14/18 |
| EP | 3581590 | A1 | * | 12/2019 | C08B 15/005 |
| WO | WO-2007/078857 | A2 | | 7/2007 | |
| WO | WO-2007/091942 | A1 | | 8/2007 | |
| WO | WO-2011/030170 | A1 | | 3/2011 | |
| WO | WO-2014142651 | A1 | * | 9/2014 | B01J 13/0034 |
| WO | WO-2014/178797 | A1 | | 11/2014 | |
| WO | WO-2015/180844 | A1 | | 12/2015 | |
| WO | WO-2021067769 | A1 | * | 4/2021 | A61B 10/0038 |

OTHER PUBLICATIONS

International Search Report, International Application No. PCT/EP2018/057289, issued by ISA/European Patent Office, 4 pages, dated Apr. 18, 2018.

Missoum, K. et.al.,Water Redispersible Dried Nanofibrillated Cellulose by Adding Sodium Chloride, Biomacromolecules, 13: 4118-4125 (2012).

Written Opinion, International Application No. PCT/EP2018/057289, issued by ISA/European Patent Office, 5 pages, dated Apr. 18, 2018.

Chevalier, E. et al., Fabrication of porous substrates: A review of processes using pore forming agents in the biomaterial field, J. Pharm. Sci., 97(3): 1135-1154 (2008).

* cited by examiner

MICROFIBRILLATED CELLULOSE FOAMS

CROSS-REFERENCE TO RELATED APPLICATIONS

This patent application is a U.S. National Stage Entry of International Patent Application No. PCT/EP2018/057289, filed on Mar. 22, 2018, which claims the benefit of priority of European Patent Application No. 17163804.2, filed on Mar. 30, 2017, the contents of each of which are hereby incorporated by reference in their entirety for all purposes herein.

FIELD OF THE INVENTION

The present invention relates to porous materials comprising or essentially consisting of microfibrillated cellulose ("MFC"). These porous materials are lightweight and can be tailored to be useful for specific applications, in particular applications in which polyurethane (PU) foams are commonly used.

The present invention also relates to a process for making the porous materials according to the present invention, in particular porous foam materials "Microfibrillated cellulose" (MFC) in accordance with the present invention is to be understood as relating to cellulose fibers that have been subjected to a mechanical treatment resulting in an increase of the specific surface and a reduction of the size of cellulose fibers, in terms of cross-section (diameter) and/or length, wherein said size reduction preferably leads to "fibrils" having a diameter in the nanometer range and a length in the micrometer range.

In cellulose, which is the starting product for producing microfibrillated cellulose (typically present as a "cellulose pulp"), no, or at least not a significant or not even a noticeable portion of individualized and "separated" cellulose "fibrils" can be found. The cellulose in wood fibres is an aggregation of fibrils. In cellulose (pulp), elementary fibrils are aggregated into microfibrils which are further aggregated into larger fibril bundles and finally into cellulosic fibres. The diameter of wood based fibres is typically in the range 10-50 μm (with the length of these fibres being even greater). When the cellulose fibres are microfibrillated, a heterogeneous mixture of "released" fibrils with cross-sectional dimensions and lengths from nm to μm may result. Fibrils and bundles of fibrils may co-exist in the resulting microfibrillated cellulose.

In the microfibrillated cellulose ('MFC') as described throughout the present disclosure, individual fibrils or fibril bundles can be identified and easily discerned by way of conventional optical microscopy, for example at a magnification of 40×.

BACKGROUND OF THE INVENTION

Cellulose based-materials can be provided in a variety of forms, for example as sheets or powder and for a variety of applications. Overall, a general need exists for light weight, porous, cellulose-based materials, e.g. aerogels which could for instance be used to replace polyurethane foams, for example in insulation applications.

Microfibrillated cellulose (also known as "reticulated" cellulose or as "superfine" cellulose, or as "cellulose nanofibrils", among others) is a cellulose-based product and is described, for example, in U.S. Pat. No. 4,481,077, U.S. Pat. No. 4,374,702 and U.S. Pat. No. 4,341,807. According to U.S. Pat. No. 4,374,702 ("Turbak"), microfibrillated cellulose has distinct properties vis-à-vis cellulose products not subjected to the mechanical treatment disclosed in U.S. Pat. No. 4,374,702. In particular, the microfibrillated cellulose described in these documents has reduced length scales (diameter, fiber length), improved water retention and adjustable viscoelastic properties. MFC with further improved properties and/or properties tailor-made for specific applications is known, among others, from WO 2007/091942 and WO 2015/180844.

Modified cellulose, in particular size-modified cellulose, is known for use in foam applications, in principle. According to the state of the art, the production of cellulose aerogels is primarily achieved by freeze drying, which is costly and time consuming. Also, the control of porosity and pore size is limited and generally requires the use of potentially hazardous solvent mixtures. For example, WO2014178797 describes the manufacture of polysaccharide aerogels by dispersing cellulose in sodium hydroxide/urea, followed by solvent exchange and freeze drying.

Missoum, K., Bras, J., Belgachem, M-N., Biomacromolecules 2012, 13, 4118-4125, discloses a dry redispersible nanofibrillar cellulose that is obtained by freeze drying from a sodium chloride (NaCl) solution.

SUMMARY OF THE PRESENT INVENTION

It is an object of the present invention to provide microfibrillated cellulose-based porous materials, in particular foam materials, that do not require freeze drying and/or do not require (or minimize) the use of potentially hazardous materials and/or that avoid (or minimize) the disadvantages of the porous cellulose-based materials of the art as exemplarily discussed above.

The inventors have surprisingly found that it is possible to produce light weight, porous, cellulose structures from microfibrillated cellulose (MFC) suspensions (in water), by way of adding water soluble salt particles of a predetermined size to said suspension to aid pore formation, then stabilize the porous structure by conventional oven drying, followed by leaching the water-soluble salt out of the dried and cured microfibrillated cellulose foam.

Pore size and porosity (density) of the foam can be controlled by adding particles of water soluble salts or compounds, in particular salts, the solubility of which in water changes by less than 25%, preferably less than 15%, further preferably less than 10% when changing the temperature from 20° C. to 100° C. One suitable example of such a salt is sodium chloride (NaCl).

The required solubility profile (in particular little change solubility as a function of temperature) is important, since the salt, in the form of particles, must be present in the mixture of MFC with solvent, in particular water, in order to create or facilitate the formation of a porous structure, in particular at the high temperatures that prevail during conventional oven drying, while the solubility should not significantly decrease when cooling down to room temperature, so that the salt can be easily leached out of the foam by dissolving the same in water. For example, NaCl has a solubility of 36 g/100 ml at room temperature (20° C.), increasing only slightly to 39 g/100 ml at 100° C.

As will be described in more detail below, the density of the foam can be controlled by varying the amount of salt, relative to the amount of MFC, while the pore size can be suitably controlled by varying the size of the salt particles.

In embodiments of the invention, the pores in the foam are closed pores and their size can be determined, for example, by way of microscopy analysis on sectional cuts of the bulk foam material. In other embodiments, in particular when the salt content is high, more and more pores may be or become open pores.

In accordance with the present invention, the density is determined as the ratio between the mass of a given foam body and the volume of the same body, for example as obtained from simple geometry calculations.

In accordance with a first aspect of the present invention, porous MFC-based materials according to the present invention are obtained by or obtainable by a method comprising at least the following steps:

(i) mixing a predetermined amount of microfibrillated cellulose in a solvent, preferably in water, together with a predetermined amount of at least one water soluble salt, so that a homogenous mixture results;

(ii) bringing the mixture of (i) into the desired shape and drying this mixture in an oven until dry, preferably at 80° C. or more, more preferably at 105° C. or more (first drying step);

(iii) after completion of step (ii), immersing the dried material of step (ii) in a solvent, preferably in water, thus leaching out at least 95%, preferably 99.5% of the salt added in step (i);

(iv) after completion of step (iii), drying this mixture from step (iii) in an oven until dry, preferably at 80° C. or more, more preferably at 105° C. or more (second drying step), resulting in a porous, salt-free material.

In a preferred embodiment, the overall method does not comprise a step of freeze-drying.

In a preferred embodiment, the overall method does not comprise the use of any solvent other than water, nor the use of any other chemical compound that functions as a pore forming agent.

The method according to the present invention may comprise additional steps, either before step (i) [pretreatment or preparatory steps], in between any or all of steps (i), (ii), (iii) and (iv), and/or after step (iv) [posttreatment step(s)].

The porous material obtained or obtainable from step (iv) does not (significantly or even noticeably) disintegrate when placed back into water. Furthermore it is not possible to convert the porous solid structure back into an MFC gel without the use of extensive externally applied forces (homogenization, etc).

Preferably, the amount of microfibrillated cellulose, i.e. the amount of microfibrillated cellulose fibers/fibrils in the solvent ("solids content") is from 1% to 30%, preferably from 2% to 20% preferably from 4% to 15%, by weight, respectively and relative to the overall weight of the solvent in the mixture of (i).

In a preferred embodiment, the weight ratio of salt present in the mixture in (i) and the solids content of MFC in the same mixture is in the range from 500:1 to 1:1, preferably form 100:1 to 5:1, further preferably from 50:1 to 5:1. As an illustration, in Example 4 as discussed below 60 g of MFC are used, at a solids content of 10% (resulting in 6 g of "dry" MFC), while 60 g of salt are used, resulting in a weight ratio of 10:1. Correspondingly, in example 5, this ratio 20:1.

Overall, without wishing to be bound by theory, it is believed that if the salt content is too low, not enough pores are formed to result in a material that is too dense for typical foam applications, while if too much salt is used, too many pores form and the foam may become structurally unstable.

The suitable amount of salt (relative to the amount of MFC) will be primarily driven by the desired density of the foam.

In embodiments of the invention, the salt as present in the mixture of step (i) is present in the form of particles that have an average particle size (D50 as measured by laser diffraction on a Sympatec RODOS) from 5 μm to 5 mm, preferably from 5 μm to 500 μm, further preferably from 10 μm to 250 μm. The choice of the salt particle size will be primarily driven by the desired pore size.

In embodiments of the invention, at least a portion of the salt, preferably more than 50 weight % of the salt, relative to the overall weight of the salt added/mixed in step (i), preferably more than 75 weight %, remain in the form of these particles during steps (i) and (ii).

In accordance with the present invention, in step (i) any salt can be used that is water-soluble. In preferred embodiments, the solubility of the salt in water changes by less than 25%, preferably less than 15%, further preferably less than 10% when changing the temperature from 20° C. to 100° C.

In preferred embodiments, the water soluble salt has a solubility in water, at 20° C., of at least 5 g/100 ml, preferably at least 15 g/100 ml, further preferably at least 25 g/100 ml, while at the same time, not too high a solubility, i.e. preferably less than 500 g/100 ml, preferably less than 250 g/100 ml, further preferably less than 100 g/100 ml. It is particularly preferred that the water soluble salt according to the present invention has a solubility of from 15 g/100 ml to 100 g/100 ml, further preferably from 25 g/100 ml to 75 g/100 ml, while, at the same time, and for all ranges and values as disclosed above, the solubility of the salt in water changes by less than 25%, preferably less than 15%, further preferably less than 10% when changing the temperature from 20° C. to 100° C.

For example, the inventors have found that the formation of microfibrillated cellulose foams works satisfactorily with sodium chloride as a salt but not satisfactorily with calcium chloride (having a solubility of 60 g/100 ml at 20° C., but 160 g/100 ml at 100° C.)

No limitation exists in regard to the oven used in step (ii) and/or step (iv), other than that the oven does not use any step of freeze-drying but rather uses the concept of increased temperature in order to remove solvent, in particular water, from the homogenous mixture of step (i) or the product of step (iii). Conventional ovens, such as convection ovens, with or without forced hot air circulation are preferred. The drying step may be performed in an inert atmosphere and/or at a pressure reduced vis-à-vis atmospheric pressure (including vacuum).

In accordance with a second aspect, the present invention relates to a solid porous material comprising or essentially consisting of microfibrillated cellulose ("MFC"), which solid porous material is characterized by:

comprising at least 85%, preferably at least 95%, further preferably at least 99% by weight, respectively, of microfibrillated cellulose, relative to the overall weight of the porous material, wherein said microfibrillated cellulose is characterized in that the length of the fibers/fibrils making up the microfibrillated cellulose is in micrometer range and the diameter of the fibers/fibrils making up the microfibrillated cellulose is in the nanometer range;

a density, measured as the ratio of weight per volume, that is from 1 to 1000 kg/m$^3$, preferably from 10 to 500 kg/m$^3$, further preferably from 10 to 200 kg/m$^3$ or from 5 to 50 kg/m$^3$.

In embodiments of the invention, the solid porous material is further characterized by absorbing water, when immersed in water at room temperature, in an amount of at least three times its weight in the dry state (3 g/g), preferably at least seven times its weight in the dry state (7 g/g), further preferably at least 15 times its weight in the dry state (15 g/g)

Water absorption was measured as described in ASTM D570 with the exception that the measurement time was 5min and the sample size was 2 cm×2 cm The solid porous material in accordance with the present invention may be characterized as a foam material. A "foam" in the meaning of the present invention, and in accordance with the definition provided by IUPAC may be characterized as being a dispersion in which a large proportion of gas by volume is dispersed in a solid, in the form of gas bubbles (see IUPAC, 1972, 31, 577: *Manual of Symbols and Terminology for Physicochemical Quantities and Units, Appendix II: Definitions, Terminology and Symbols in Colloid and Surface Chemistry,* on page 606).

In embodiments with the invention, the porous material, in particular the foam, is coated with a hydrophobic agent, in order to produce a porous material with hydrophobic properties, i.e. preferential interaction with non-polar molecules and repulsive interaction with polar molecules.

In preferred embodiments, the hydrophobic agent is selected from a siliconate or a polymer. The siliconate may be an alkyl siliconate. The metal siliconate may be potassium methyl siliconate or sodium methyl siliconate. The polymer may be a polyester. The polyester may be a nylon polyester. In other embodiments, the hydrophobic agent may be a silane compound.

In preferred embodiments, the porous material may be functionalized with a silane compound. The silane compound may comprise at least one functional group selected from the group consisting of alkenyl, alkyl, alkoxy, benzyl, acryloxy, amino, ureide, sulfide, isocyanurate, mercapto, and isocyanate.

The silane compound may be selected from the group consisting of methyltrimethoxysilane, vinyltrimethoxysilane, vinyltriethoxysilane, 2-(3,4 epoxycyclohexyl) ethyltrimethoxysilane, 3-Glycidoxypropyl trimethoxysilane, 3-Glycidoxypropyl methyldiethoxysilane, 3-Glycidoxypropyl triethoxysilane, p-Styryltrimethoxysilane, 3-methacryloxypropyl methyldimethoxysilane, 3-methacryloxypropyl trimethoxysilane, 3-methacryloxypropyl methyldiethoxysilane, 3-methacryloxypropyl triethoxysilane, 3-acryloxypropyl trimethoxysilane, (aminoethyl)-3-aminopropylmethyldimethoxysilane, N-2-(aminoethyl)-3-aminopropyltrimethoxysilane, 3-aminopropyltrimethoxysilane, 3-aminopropyl triethoxysilane, N-phenyl-3-aminopropyltrimethoxysilane, tris-(trimethoxysilylpropyl) isocyanurate, 3-ureidopropyltriethoxysilane, 3-mercaptopropylmethyldimethoxysilane, 3-mercaptopropyltrimethoxysilane, bis(triethoxysilylpropyl)tetrasulfide, 3-isocyanate propyltriethoxysilane fluorosilanes, trichloromethylsilane (TCMS), trichloroethylsilane, trichloro(n-probyl)silane, trimethoxymethylsilane, triethoxymethylsilane, (3-phenylpropyl) methyldichlorosilane (PMDS), benzyltrichlorolane, methylbenzyl-trichlorosilane, trifluoromethylbenzyltrichlorosilane, methyltriethoxysilane, (3-phenylpropyl) methyl dimethoxysilane, (3-phenylpropyl) methyldiethoxysilane, Tris(trimethylsiloxy) chlorosilane (Tris-TMSCl), Tris(trimethylsiloxy) silylethyldimethylchlorosilane, and/or Bis(trimethylsiloxy) methylsilylethyldimethylchlorosilane.

In accordance with the present invention, the term "hydrophobic" is to be understood to be the opposite of the term "hydrophilic" as defined in IUPAC: Compendium of Chemical Terminology, 2nd ed. (the "Gold Book"), compiled by A. D. McNaught and A. Wilkinson. Blackwell Scientific Publications, Oxford (1997), ISBN 0-9678550-9-8, as generally referring to the capacity of a molecular entity or of a substituent to interact with polar solvents, in particular with water, or with other polar groups.

Uses

The porous material according to the present invention may be provided or produced in any conceivable form or shape and is provided, for example in large sheets for use in insulation or construction, for example.

In general, the materials produced by the invention can be used in the same applications in which polyurethane foam is known to be used, in particular in insulation, construction, furniture, transportation devices or in sports equipment, as well as as filler material.

The porous microfibrillated cellulose-based materials according to the present invention may also be used to absorb toxic compounds, metals or pigments from water or solvents. The materials of the present invention may also be used in membranes, thin films, in particular as filter materials.

Furthermore, the porous microfibrillated cellulose-based materials according to the present invention may also be used in the medical field, for example in drug release, implants, cell culturing, etc.

The porous microfibrillated cellulose-based materials according to the present invention may also be used to create materials which contain compounds of low solubility, organosoluble compounds, metals (silver, palladium, etc.) and active compound (pharmaceutically active, pesticides, fungicides, etc.) to be used, e.g., for sustained delivery.

Advantages/Effects

The porous microfibrillated cellulose-based materials according to the present invention allow for the tailor-making of porous structures based on a naturally occurring and renewable resource (cellulose, here, in particular microfibrillated cellulose), using an industrially applicable method, at low cost. In particular, since it has been found surprisingly, that the simple addition of particles of a salt or a salt mixture allows to form and adjust pores (pore sizes) and/or density of the foam, all the while no (expensive) freeze drying is required. Also, the method does not use any or at least no significant amounts of harmful chemicals or solvents.

DETAILED DESCRIPTION OF THE INVENTION

The invention is described in more detail in the following, with reference to the enclosed figures, which are only meant to be illustrative, wherein.

Figure 1:
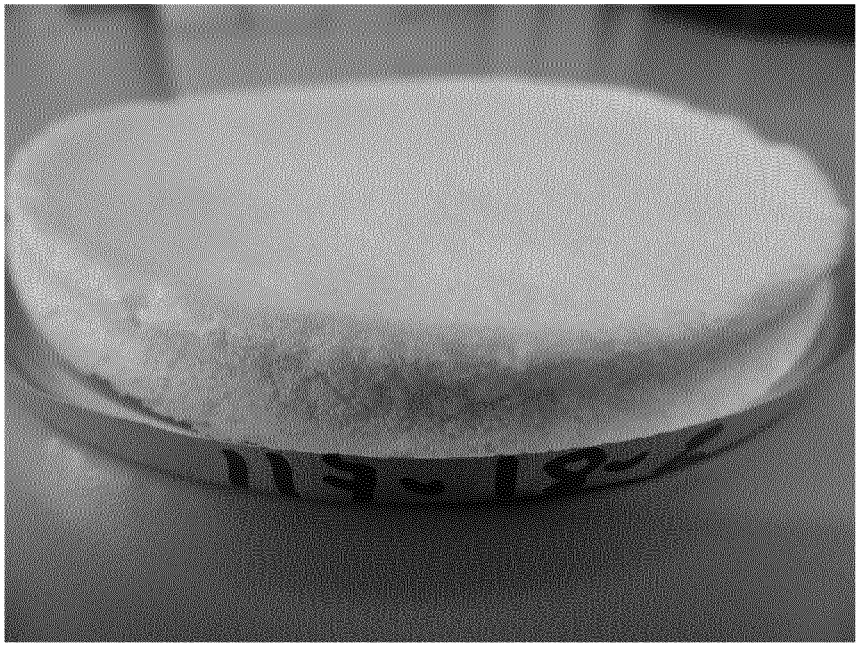
FIG. 1 shows a picture of a foam material in [porous disk (5.84 g), Example 4] in accordance with the present invention.

In principle, any type of microfibrillated cellulose (MFC) can be used to make the porous materials in accordance with the present invention, as long as the fiber bundles as present in the original cellulose pulp are sufficiently disintegrated in the process of making MFC so that the average diameter of the resulting fibers/fibrils is in the nanometer-range and therefore more surface of the overall cellulose-based material has been created, vis-à-vis the surface available in the original cellulose material. MFC may be prepared according to any of the processes described in the art, including the prior art specifically cited in the "Background"-Section above.

Origin of the Cellulose Used to Prepare the MFC

In accordance with the present invention, there is no specific restriction in regard to the origin of the cellulose, and hence of the microfibrillated cellulose. In principle, the raw material for the cellulose microfibrils may be any cellulosic material, in particular wood, annual plants, cotton, flax, straw, ramie, bagasse (from sugar cane), suitable algae, jute, sugar beet, citrus fruits, waste from the food processing industry or energy crops or cellulose of bacterial origin or from animal origin, e.g. from tunicates.

In a preferred embodiment, wood-based materials are used as raw materials, either hardwood or softwood or both (in mixtures). Further preferably softwood is used as a raw material, either one kind or mixtures of different soft wood types. Bacterial microfibrillated cellulose is also preferred, due to its comparatively high purity.

Modified (Derivatized) and Non-Modified (Un-Derivatized) Cellulose/MFC

In principle, the microfibrillated cellulose in accordance with the present invention may be unmodified in respect to its functional groups or may be physically modified or chemically modified, or both.

However, in preferred embodiments of the present invention, the microfibrillated cellulose is not modified, in particular not TEMPO-oxidized, as the pore-forming effect of the salt particles may be reduced if the microfibrillated cellulose is modified, in particular oxidized in accordance with the TEMPO process.

Chemical modification of the surface of the cellulose microfibrils may be achieved by various possible reactions of the surface functional groups of the cellulose microfibrils and more particularly of the hydroxyl functional groups, preferably by: oxidation, silylation reactions, etherification reactions, condensations with isocyanates, alkoxylation reactions with alkylene oxides, or condensation or substitution reactions with glycidyl derivatives. Chemical modification may take place before or after the defibrillation step.

The cellulose microfibrils may, in principle, also be modified by a physical route, either by adsorption at the surface, or by spraying, or by coating, or by encapsulation of the microfibril. Preferred modified microfibrils can be obtained by physical adsorption of at least one compound. The MFC may also be modified by association with an amphiphilic compound (surfactant).

However, in preferred embodiments, the microfibrillated cellulose is not physically modified.

In a preferred embodiment of the present invention, the microfibrillated cellulose as used in step (i) is prepared by a process, which comprises at least the following steps:

(a) subjecting a cellulose pulp to at least one mechanical pretreatment step;

(b) subjecting the mechanically pretreated cellulose pulp of step (a) to a homogenizing step, which results in fibrils and fibril bundles of reduced length and diameter vis-à-vis the cellulose fibers present in the mechanically pretreated cellulose pulp of step (a), said step (b) resulting in microfibrillated cellulose;

wherein the homogenizing step (b) involves compressing the cellulose pulp from step (a) and subjecting the cellulose pulp to a pressure drop.

The mechanical pretreatment step preferably is or comprises a refining step. The purpose of the mechanical pretreatment is to "beat" the cellulose pulp in order to increase the accessibility of the cell walls, i.e. to increase the surface area.

A refiner that is preferably used in the mechanical pretreatment step comprises at least one rotating disk. Therein, the cellulose pulp slurry is subjected to shear forces between the at least one rotating disk and at least one stationary disk.

Prior to the mechanical pretreatment step, or in addition to the mechanical pretreatment step, enzymatic (pre)treatment of the cellulose pulp is an optional additional step that may be preferred for some applications. In regard to enzymatic pretreatment in conjunction with microfibrillating cellulose, the respective content of WO 2007/091942 is incorporated herein by reference. Any other type of pretreatment, including chemical pretreatment is also within the scope of the present invention.

In the homogenizing step (b), which is to be conducted after the (mechanical) pretreatment step, the cellulose pulp slurry from step (a) is passed through a homogenizer at least once, preferably at least two times, as described, for example, in PCT/EP2015/001103, the respective content of which is hereby incorporated by reference.

EXAMPLES

Example 1

Preparation of Microfibrillated Cellulose

MFC as used to make the porous materials in accordance with the present invention is commercially available and commercialized by Borregaard as "Exilva F01-V", based on cellulose pulp from Norwegian spruce (softwood).

The MFC in step (i) was present as a paste, having a solids content of 10%. The solvent was water.

Example 2

Preparation of Cellulose Foam 50 g of the MFC from Example 1 (solids content: 10%) was carefully mixed with 50 g of NaCl (Aldrich 31434N; D50 particle size: 400 μm). The resulting paste was formed into a disk shape form and dried at 105° C. overnight. The dried disk was then immersed in distilled water (200 ml) and kept for 4 h. The water was changed 3 times, after which steps the disk was dried at 105° C. overnight, resulting in porous disk (4.8 g).

Example 3

Re-Dispersion Test of Cellulose Foam 2 g of the material obtained from Example 2 was mixed with 198 g of distilled water. The mixture was mixed with Ultra Turrax 4 min/10000 rpm, resulting in a suspension with visible phase separation meaning that the product is not re-dispersible.

Example 4

Preparation of Cellulose Foam 60 g of MFC from Example 1 (solids content: 10%) was carefully mixed with 60 g of NaCl. The paste was spread onto a glass petri dish with a diameter of 9 cm and height of 1.2 cm and dried at 45° C. overnight and then at 105° C. overnight. The dry disk was immersed in distilled water (250 ml) for 1 hour. The water was changed 3 times, after which the disk was dried at 105° C. for 8 hours, resulting in a porous disk (5.84 g), 8.7 cm diameter and 0.8 cm thickness. (see FIG. 1).

Example 5

Figure 2:
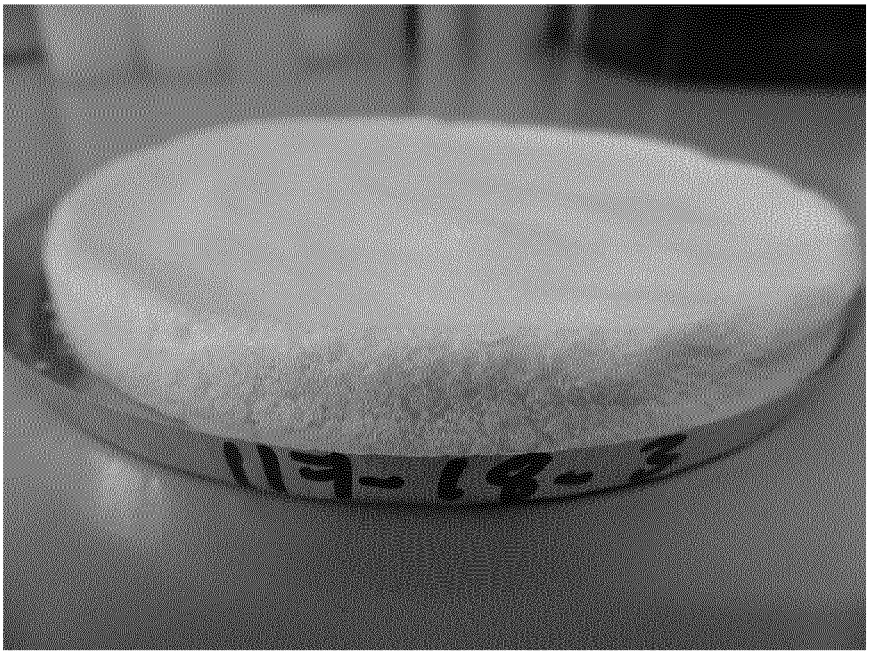
FIG. 2 shows a picture of a foam material [porous disk (4.76 g), Example 5] in accordance with the present invention.

Preparation of Cellulose Foam 50 g of Exilva F 01-V from Example 1 (10% solids content) was carefully mixed with 100 g of NaCl. The paste was spread to a glass petri dish with a diameter of 9 cm and height of 1.2 cm and dried at 45° C. overnight and then at 105° C. overnight. The dry disk was immersed in distilled water (400 ml) for 1 hour. The water was changed 3 times, after which the disk was dried at 105° C. for 8 hours, resulting in a porous disk (4.76 g), 8.8 cm diameter and 0.9 cm thickness (see FIG. 2).

Example 6

Water Absorption of Cellulose Foam 321 mg (approximately 2 cm×2 cm) of the material obtained from Example 4 was immersed in distilled water. After 5 min the piece was removed from water, carefully tapped dry from excess water. The weight of the piece was 1.44 g.

Example 7

Water Absorption of Cellulose Foam 259 mg (approximately 2 cm×2 cm) of the material obtained from Example 5 was immersed in distilled water. After 5 min the piece was removed from water, carefully tapped dry from excess water. The weight of the piece was 2.22 g.

Example 8

Comparative Example

Figure 3:
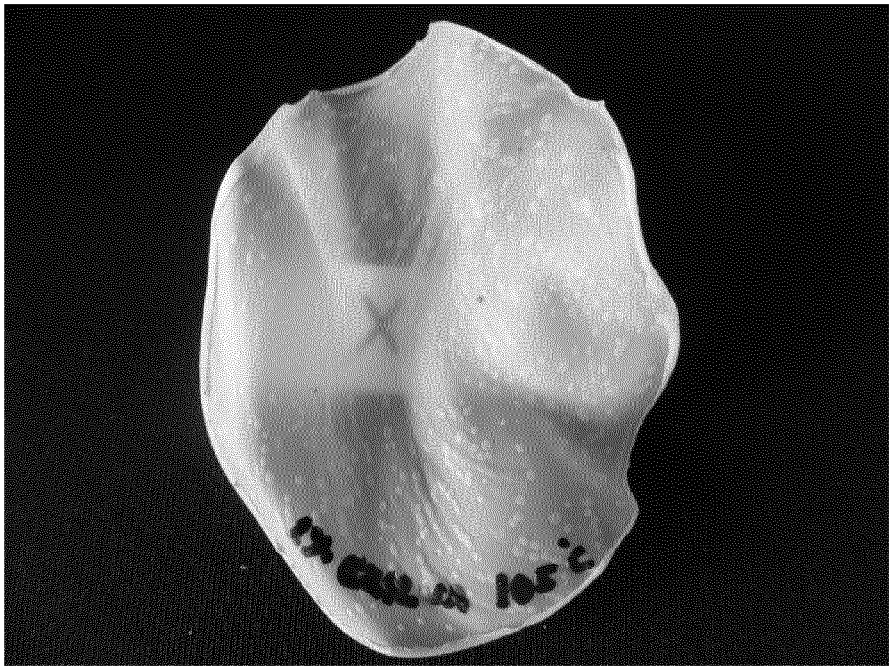
FIG. 3 shows a picture of a dried MFC-based material that is not in accordance with the present invention (Example 8).

Water Absorption of Cellulose Film 10 g of MFC from Example 1 (10% solids content, no salt added) was carefully mixed with 40 g of water. The suspension was dried on a glass petri dish with a diameter of 9 cm and height of 1.2 cm and dried at 105° C. overnight, resulting in a thin film. A piece of film (486 mg) was immersed in distilled water. After 5 min the film piece was removed from water, carefully tapped dry from excess water. The weight of the film was 816 mg. (see FIG. 3).

Figure 4:
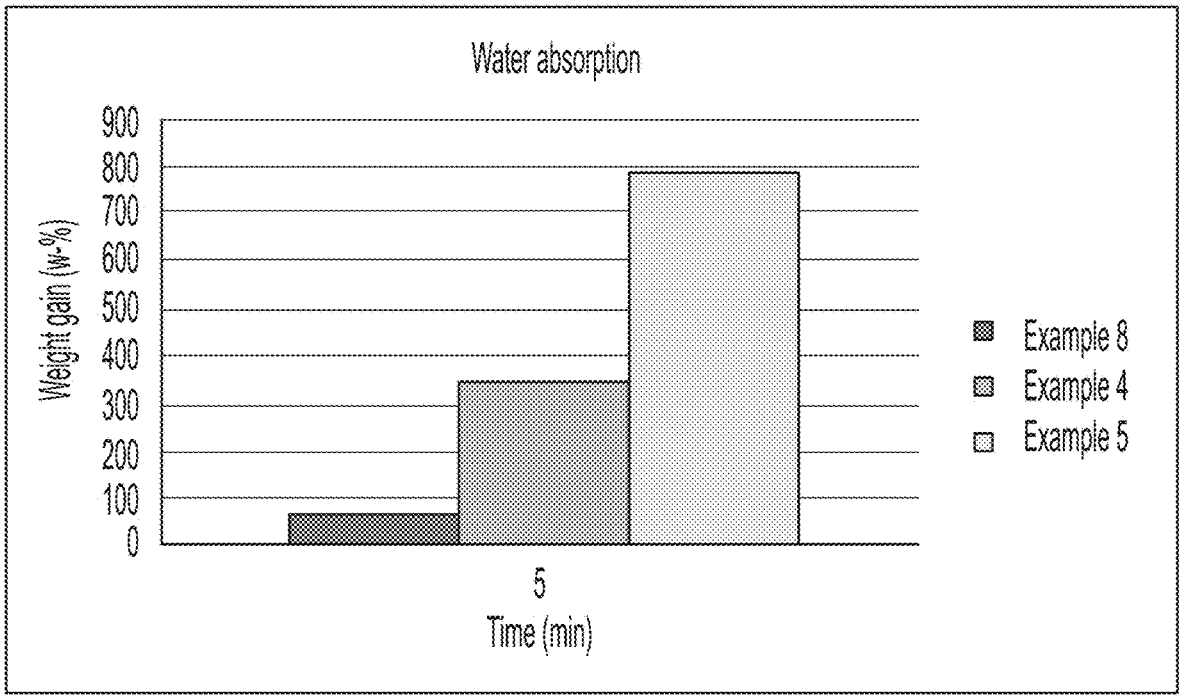
FIG. 4 shows a comparison of absorption values for materials in accordance with the present invention and materials not in accordance with the present invention.

FIG. 4 shows a comparison of water absorption of cellulose foam (Examples 4 and 5, second and third bar from the left, respectively in accordance with the present invention) vis-à-vis the film-like material (no salt) of comparative Example 8 (leftmost bar).

The invention claimed is:

1. Method for making porous, microfibrillated cellulose based materials, said method comprising at least the following steps:

(i) mixing a predetermined amount of microfibrillated cellulose (MFC) in a solvent together with a predetermined amount of at least one water soluble salt, so that a homogenous mixture results;

(ii) bringing the mixture of (i) into a desired shape and drying this mixture in an oven until dry (first drying step);

(iii) after completion of step (ii), immersing the dried material of step (ii) in a solvent thus leaching out at least 95% of the at least one water soluble salt added in step (i);

(iv) after completion of step (iii), drying this mixture from step (iii) in an oven until dry (second drying step), wherein a resulting material after step (iv) is porous.

2. Method according to claim 1, wherein each of the at least one water soluble salt is characterized in that the solubility of said salt in water changes by less than 25% when changing the temperature from 20° C. to 100° C.

3. Method according to claim 1, wherein the method does not comprise a step of freeze-drying.

4. Method according to claim 1, wherein an amount of microfibrillated cellulose is from 1% to 30% by weight relative to a weight of solvent in the mixture of (i).

5. Method according to claim 1, wherein a weight ratio of salt present in the mixture in (i) and a solids content of MFC in the same mixture is in a range from 500:1 to 1:1.

6. Method according to claim 1, wherein the at least one water soluble salt as present in the mixture of step (i) is present in the form of particles that have an average particle size from 5 μm to 5 mm.

7. Method according to claim 6, wherein at least a portion of said at least one water soluble salt remains in the form of these particles during steps (i) and (ii).

8. Method according to claim 1, wherein the solvent is water.

9. Method according to claim 1, wherein each of the at least one water soluble salt has a solubility in water, at 20° C., of from 15 g/100 ml to 100 g/100 ml.

10. Method according to claim 1, wherein the method does not comprise use of any solvent other than water.

* * * * *